US005879201A

United States Patent [19]

Fukamachi et al.

[11] Patent Number: 5,879,201

[45] Date of Patent: Mar. 9, 1999

[54] CONNECTOR

[75] Inventors: Makoto Fukamachi; Osamu Ito, both of Yokkaichi, Japan

[73] Assignee: Sumitomo Wiring Systems, Ltd., Yokkaichi, Japan

[21] Appl. No.: 904,314

[22] Filed: Jul. 31, 1997

[30] Foreign Application Priority Data

Jul. 31, 1996 [JP] Japan ..... 8-201919

[51] Int. Cl.[6] ..... H01R 13/436

[52] U.S. Cl. ..... 439/752

[58] Field of Search ..... 439/752, 680

[56] References Cited

U.S. PATENT DOCUMENTS

| | | | |
|---|---|---|---|
| 4,867,712 | 9/1989 | Kato et al. | 439/752 |
| 5,203,722 | 4/1993 | Kinoshita | 439/752 |
| 5,403,212 | 4/1995 | Aimasso | 439/752 |
| 5,613,881 | 3/1997 | Ichida et al. | 439/680 |

FOREIGN PATENT DOCUMENTS 4-23391 4/1992 Japan .

*Primary Examiner*—Gary F. Paumen
*Attorney, Agent, or Firm*—Greenblum & Bernstein, P.L.C.

[57] ABSTRACT

The present invention relates to a connector equipped with a retainer that prevents a terminal that has been inserted into a connector housing from disengaging. To prevent the unexpected movement of the retainer to the fully engaged position and to be able to detect whether the retainer is fully engaged, the outer faces of the retainer do not extend above the outer faces of the connector housing when the retainer is in a partially engaged position. Thus, the retainers are not pushed into a fully engaged position by other members. Moreover, because the projections that extend above the connector housings are placed on the outer face of the retainers, the projections seldom interfere with other elements. When the connector housings are coupled with the receiving parts of the frame in a partially engaged position, the projections interfere with the open edges of the receiving parts and thus prevent the connector from achieving the fully engaged position. However, when the retainers are fully engaged, the projections have descended to a position whereby they no longer interfere with the open edges of the receiving parts, and therefore the coupling becomes possible.

5 Claims, 4 Drawing Sheets

CONNECTOR

BACKGROUND OF THE INVENTION

1. Field of the Invention

The present invention relates to an improved connector which has both the ability to prevent the unexpected movement of a retainer into the fully engaged position and the ability to detect whether the retainer is partially or fully engaged.

2. Background Information

It has been known to have a connector equipped with a retainer that prevents the release of a terminal that has been inserted into a connector housing. The known connector prevents the release of the terminal in the disengagement direction after the terminal is compressed to full engagement from the partially inserted position.

In the known connector, the retainer, which extends above the connector housing, is partially assembled with the connector in a partially engaged position before being transported to the place of assembly. This known connector is disadvantageous because, while in this partially engaged position, it is possible to accidently compress the retainer into the fully engaged position during transport to the place of assembly. For this reason, the retainer and housing connector are often transported to the place of assembly without being partially assembled.

The known connector is designed to easily detect whether the retainer is in the fully engaged or partially engaged position. The known connector is equipped with a retainer that can be stored in the recess of the frame or opposed member. When the retainer is in the temporarily engaged position, the retainer extends from the outside face of the connector. This extension causes the retainer to interfere with the open edge of the connector and, thus, prevents full engagement. When the retainer is moved to the fully engaged position, the retainer is designed to become positioned in the same plane as or recessed in the outside face of the connector. Thus, the position of the retainer facilitates detecting whether the retainer is fully or partially engaged.

As described above, when the connector is designed such that the retainer extends from the outer face of the connector's housing, the retainer can be accidently engaged. Conversely, when the connector is designed such that the retainer does not extend from the outer face of the connector's housing, it is not possible to detect whether the retainer is fully engaged.

Thus, present technology does not provide for a connector that both prevents the unexpected movement of the retainer to the fully engaged position coupled with a function for detecting whether the retainer is temporarily or fully engaged.

SUMMARY OF THE INVENTION

Accordingly, the present invention overcomes the disadvantages discussed above by providing a connector which prevents the unexpected movement of a retainer to the fully engaged position while also enabling one to detect whether the retainer is either partially or fully engaged.

The invention includes a connector equipped with a connector housing capable of being coupled with the receiving part of a frame. After the connector becomes fully engaged with the receiving part of a frame, the connector is prevented from moving in the disengagement direction. The retainer prevents the movement of the connector in the disengagement direction by first allowing the connector to become partially engaged with the connector housing, and then by allowing the retainer to become fully engaged by pushing the connector from the partially engaged position to the fully engaged position.

The connector housing is temporarily prevented from reaching the full engagement position due to a projection proximately located on the outer face of a retainer. The projection is capable of interfering with the open edge of the receiving part of the frame by extending above the outer face of the connector housing. The interference created by the projection prevents the retainer from achieving full engagement. Upon pushing the projection into a position of non-interference with the open edge of the receiving part, the connector then becomes fully engaged. When the connector is partially engaged, the area, excluding the projection, on the outer face of the retainer does not extend above the outer face of the connector housing.

The preferred embodiment of the invention further includes ribs which are located near the projection on the outer face of the connector housing. The ribs extend above the outer face of the connector housing on either side of the projection and prevent other members from interfering with the projections. The ribs further assist the placement of the connector housing in the proper position for engagement with the receiving part of the frame. When the connector housing couples with the frame, the ribs are designed to enter into complementary recesses formed in the receiving part; thus, the ribs do not prevent the coupling of the connector housing with the frame.

In the present invention, when the retainer of the connector housing is in the partially engaged position, there is no fear that other elements will interfere with the outer face of the retainer and cause the retainer to become fully engaged because a broad region of the outer face of the retainer, excluding projections, does not extend above the outer face of the connector housing. Rather, the projections protrude from a limited area on the outer face of the connector housing such that the projections seldom interfere with other members.

When the retainer is pushed into the fully engaged position, the projections descend and are housed within an open space of the frame. Thus, the coupling of the connector housing and the frame is easily accomplished. Yet, when the retainer of the connector housing is in the partially engaged position, the projections interfere with the open space of the receiving part and thus prevent the retainer of the connector housing from becoming fully engaged.

In the present invention, the retainer is capable of preventing the unexpected movement of the retainer from the partially engaged position to the fully engaged position and detecting whether the retainer is in the partially engaged or fully engaged position.

The preferred embodiment of the invention further includes ribs which are located near the projections on the outer face of the connector housing and which extend above the outer face of the connector housing. The ribs are positioned to couple with other elements. When the retainer is in the partially engaged position, the ribs protect the projections from contacting other members by contacting the other members before the projections so contact. The contact between ribs and other members decreases the likelihood of an unexpected or unintended movement from the partially engaged position of the retainer to a fully engaged position. When the retainer is intended to become fully engaged, a recess is formed at the open edge of the receiving part to receive the ribs; thus, the ribs do not prevent the connector housing from coupling with the receiving part of the frame.

A preferred embodiment of the invention includes a connector including a connector housing that is capable of being coupled with a receiving part. The retainer moves within the connector housing from a partially engaged position to a fully engaged position. The retainer further prevents the terminal from being disengaged from the connector housing after the terminal is fully engaged in the connector housing. The retainer does not extend above the outer face of the connector housing when the retainer is partially and fully engaged. The connector further includes a projection located on the outer face of the retainer.

The preferred embodiment of the connector further includes a projection that extends above the outer face of the connector housing when the retainer is partially engaged. When the retainer is partially engaged, the projection interferes with the open edge of the receiving part. The projection descends to a position within the connector housing whereupon the projection no longer interferes with the open edge of the receiving part. The projection then allows the connector housing to move from a partially engaged position to a fully engaged position when the retainer is fully engaged.

The preferred embodiment of the invention further includes at least one rib located near the projection on the outer face of a connector housing. At least one rib extends from the outer face of the connector housing and the at least on rib is designed not to interfere with the open edge of the receiving part when the connector housing is being coupled with the receiving part. In this preferred embodiment, the receiving part includes at least one complementary recess to receive the at least one rib so that the at least one rib does not interfere with the open edge of the receiving part and allows the connector housing to become fully engaged. Preferably, the connector includes two ribs with one rib located on either side of the projection.

A preferred embodiment of the invention further includes a connector wherein the retainer includes an engaging part that holds the terminal in an engaged position. Moreover, the retainer is vertically movable within the connector housing.

A preferred embodiment of the invention further includes a projection and at least one rib wherein the top surface of the projection is positioned below the upper surface of each of the ribs.

BRIEF DESCRIPTION OF THE DRAWINGS

The invention will be better understood by referring to the description which follows with reference to the drawings, which illustrate by way of non-limiting examples, embodiments of the invention, with like reference numbers representing similar parts throughout the several views, and wherein.

DETAILED DESCRIPTION OF THE PREFERRED EMBODIMENTS

Figure 1:
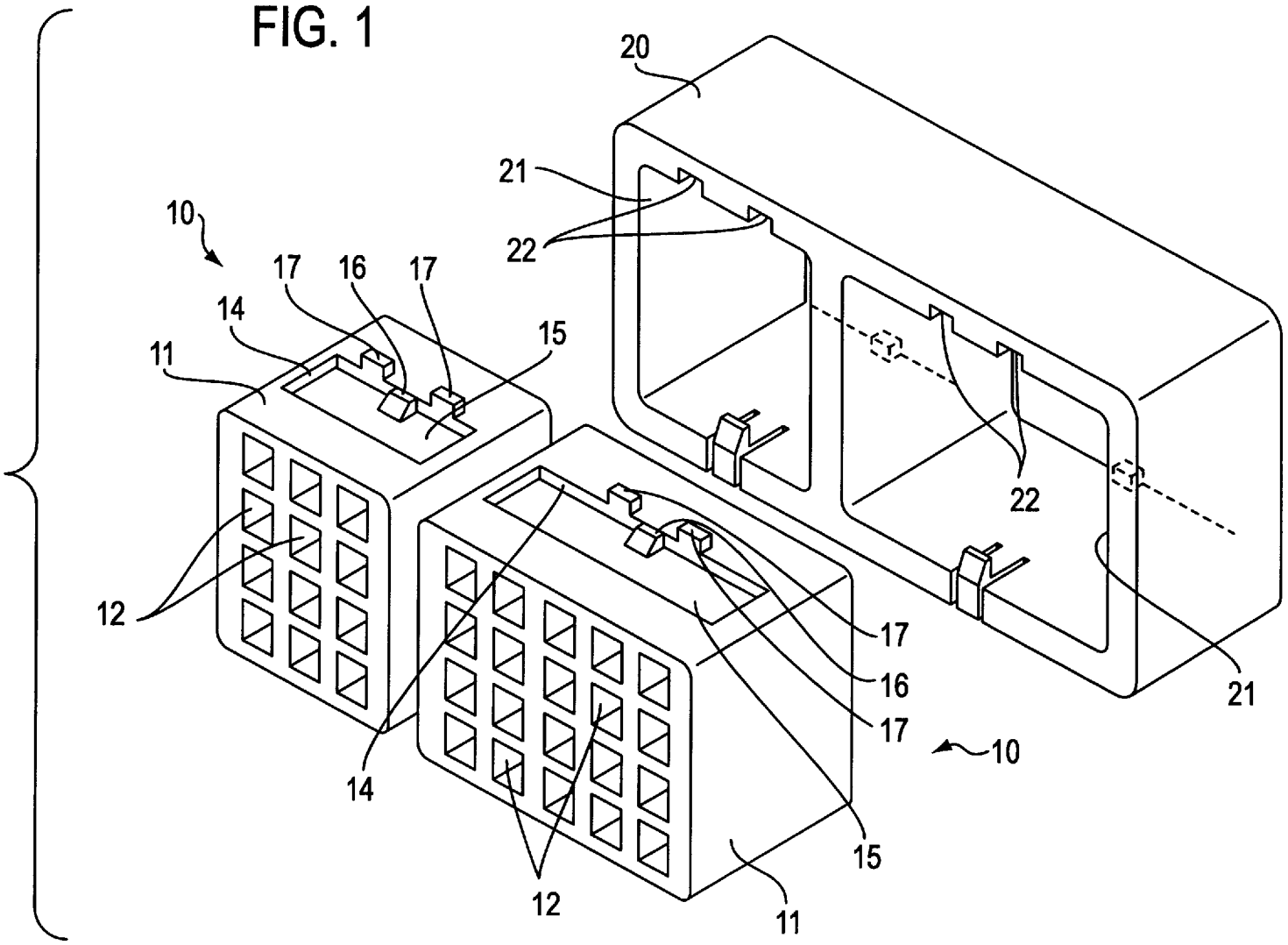
FIG. 1 is a perspective view of the connector completely removed from the frame.

One preferred embodiment of the present invention is illustrated by referring to FIGS. 1 through 5 as follows.

The connectors of the present embodiment include the connector 10, which has a divided structure, formed to couple with the receiving parts 21, which has a complementary divided structure and a frame 20. Connector 10 further includes a connector housing 11, and within the connector housing 11 is a retainer 15.

Figure 3:
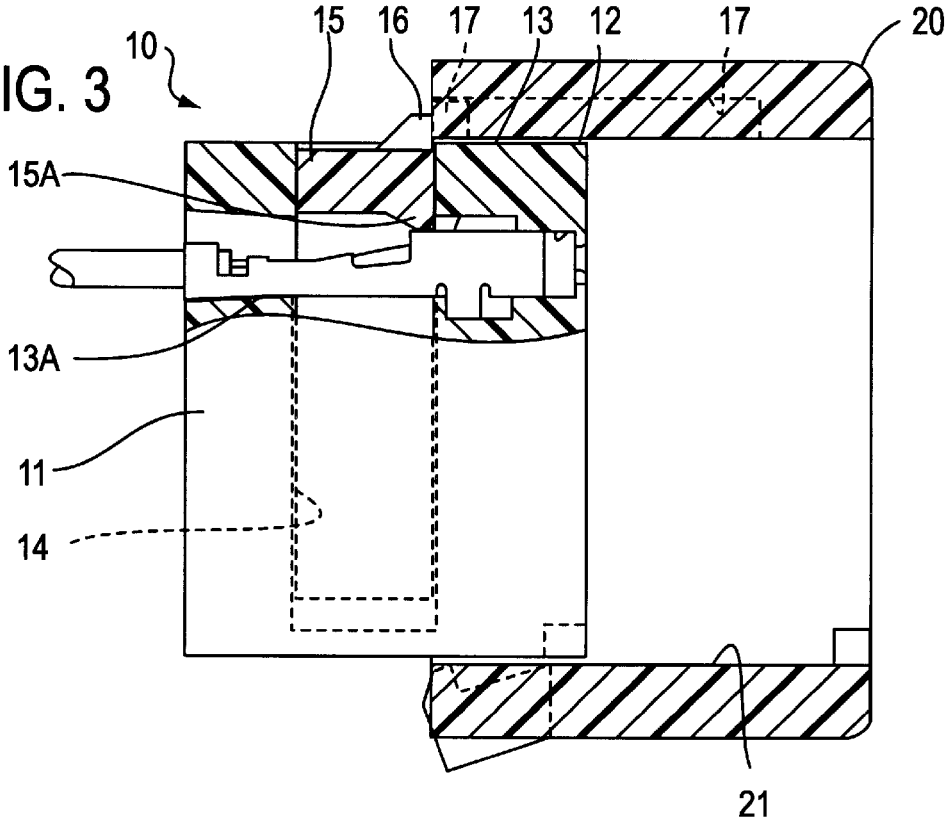
FIG. 3 is a cross-sectional side view of the connector wherein the retainer is partially engaged and the coupling of the connector with the recess of the frame is prevented.
Figure 4:
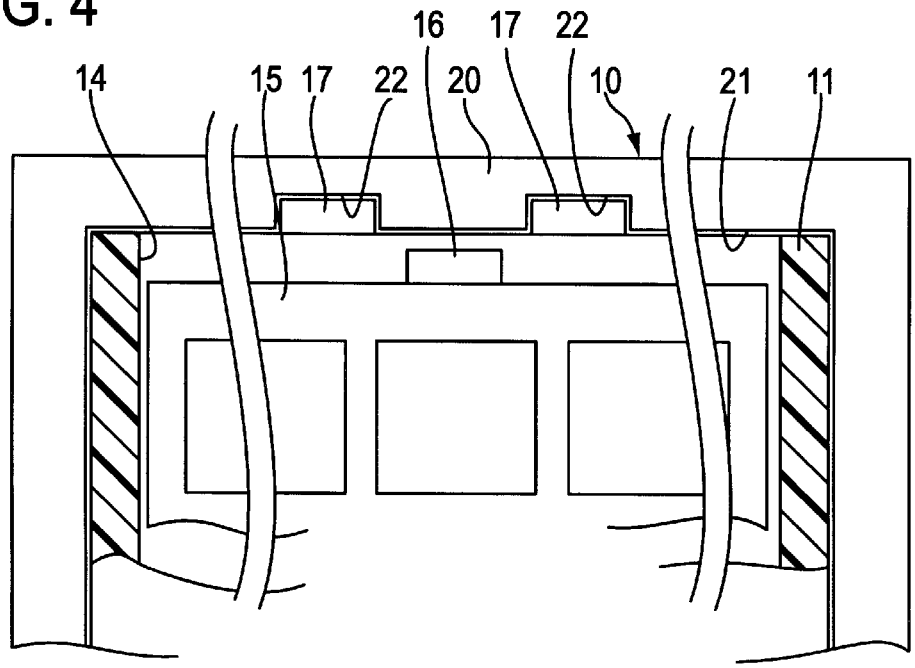
FIG. 4 is a cross-sectional end view of the connector wherein the retainer is fully engaged and coupled with the recess of the frame.
Figure 5:
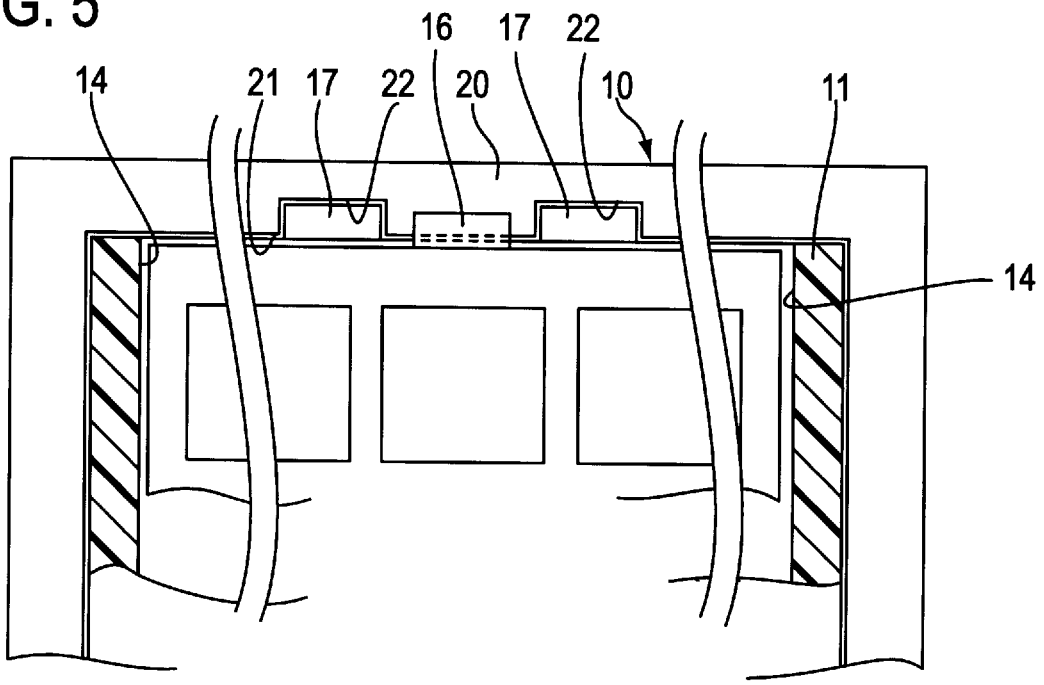
FIG. 5 is a cross-sectional end view of the connector wherein the retainer is partially engaged and partially coupled with the recess of the frame.

In the inner part of the connector housings 11, a plurality of cavities 12 are formed. Within the respective cavities 12, the respective female terminals 13 are inserted from the rearward opening. Located in the connector housings 11, are storing chambers for the retainers 14. Storing chambers 14 open toward the upper face and lead to all cavities 12. The retainers 15 are selectively retained in the partially engaged position, as illustrated in FIGS. 3 and 5, and the fully engaged position illustrated in FIG. 4. The engagement procedure by which the retainers move from the partially engaged position to the fully engaged position is not illustrated in the Figures. While the retainers 15 are in the partially engaged position, it is possible to insert the female terminals 13 into the cavities 12. When the retainers 15 are moved to the fully engaged position while properly engaging the female terminals 13, the engaging parts 15A of the retainers 15 engage the engaging parts 13A of the female terminals 13. Thus, the ability of the female terminals 13 to move in the disengagement direction is prevented.

Moving the retainers 15 from the partially engaged position into the fully engaged position is accomplished by pushing on the upper face of the retainers 15 and pushing the retainers into the connector housings 11. The position of the upper face of the retainers 15 is described as follows. In the partially engaged position, the upper face of the retainers 15, excluding the projections 16 (described below), is situated in the same plane as the upper face of the connector housings 11 or at a height slightly lower than the plane. Specifically, in the partially engaged position, the upper faces of the retainers 15 do not extend above the upper faces of the connector housings 11. When the retainers 15 are pushed into the fully engaged position, the upper faces of the retainers 15 are lower than the upper faces of the connector housings 11 and are hidden from view.

On the upper faces of the retainers 15, the projections 16 are formed such that they extend above the faces of the retainers 15. The projections 16 are located in a particular region of the upper faces of the retainers 15. Specifically, in one preferred embodiment, the projections 16 are located in the center position along the front edges of the retainers 15. The projections 16 occupy only a small area on the upper faces of the retainers 15. The projections 16 extend above the upper faces of the connector housings 11 when the retainer 15 is in the partially engaged position and are capable of interfering with the open edges of the receiving parts 21 of the frame 20, as described below. When the retainers 15 are pushed into the fully engaged position, the projections 16 descend into the retainers' storing chambers 14 until the projections 16 no longer extend above the upper faces of the connector housings 11 and no longer interfere with the open edges of the receiving parts 21.

According to another aspect of the invention, two sets of ribs 17 are formed on the upper faces of the connector housings 11. The ribs 17 prevent other elements from interfering with the function of the projections 16 when the retainer is in the partially engaged position. To accomplish this, the ribs 17 are placed, within a short distance, on both the left and the right side of the projections 16 at the front edge of the storing chambers of the retainers 14. Further, when the retainer 15 is in the partially engaged state, the ribs 17 are designed to extend slightly higher than the projections 16.

The frame 20, to which the connector housings 11 are fitted, have recesses 22 that prevent the ribs 17 from interfering with the open edges of the receiving parts 21 when the connector housings 11 are coupled with the receiving parts 21 of the frame 20.

The connectors 10 of the embodiment of FIGS. 1–5 are assembled and coupled with the frame 20 by the following procedure. First, the retainers 15 are partially engaged with the connector housings and transported to a second assembly spot for full assembly. While the retainers 15 are in the partially engaged position, there is no fear that the retainers 15 will be accidently pushed into the fully engaged position because other elements extend above the upper faces of the retainers 15 during transport.

Further, in the partially engaged position, the projections 16 of the retainers 15 extend above the upper faces of the connector housing 11. The projections 16 are not constructed to cover the entire area of the upper faces of the retainers 15, but only a small portion thereof. Further, because the ribs 17 extend higher than the projections 16 and are formed near the projections 16, there is very little fear that other elements will interfere with the projections 16 and allow the retainers 15 to be pushed into the fully engaged position.

Figure 2:
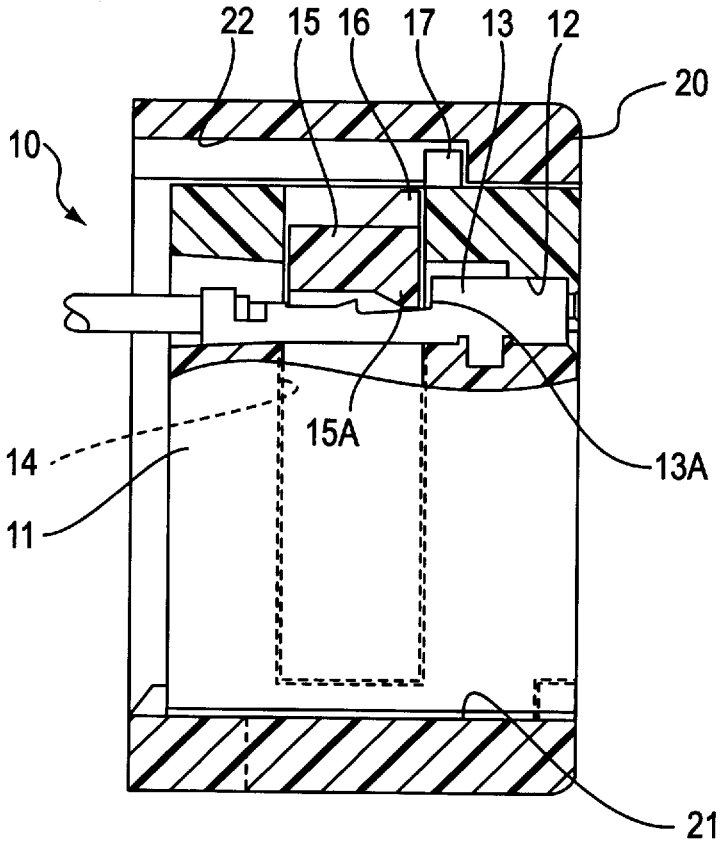
FIG. 2 is a cross-sectional side view of the connector wherein the retainer is fully engaged and successfully coupled with the recess of the frame.

The female terminals 13 are inserted into the connector housings 11 when the retainers 15 are in the partially engaged position. When the female terminals 13 are properly inserted into the cavities 12, as shown in FIG. 2, the retainers 15 can be moved into the fully engaged position by pushing the upper faces of the retainers 15. When the retainers 15 are fully engaged, movement toward the disengagement direction is prevented by the engagement of the regulating part 15A of retainer 15 and the engaging parts 13A of the female terminals 13. When the retainer 15 is fully engaged, the projections 16 of the upper face descend into the storing chambers of the retainers 14 so that the projections 16 no longer extend above the connector housings 11.

As described above, once the assembly of the female terminals 13 with the retainers 15 is complete, the connector 10 cooperates with the receiving parts 21 of the frame 20. Because the projections 16 no longer extend above the upper faces of the connector housings 11, the connector housings 11 are easily coupled. The coupling of the connector housings 11 is further facilitated by the ribs 17, located on the upper faces of the connector housings 11, entering into corresponding recesses 22 without interfering with the open edges of the receiving parts 21.

Further, at the location where the connector housings 11 are coupled with the frame 20, one can detect whether the retainers 15 are accurately pushed into the fully engaged position. Specifically, when the retainers 15 are fully engaged, the coupling of the connector housings 11 and the receiving parts 21 is performed with ease. However, when the coupling is attempted after inserting the female terminals 13, but without pushing the retainers 15 into the fully engaged position, the projections 16 prevent the coupling by extending above the upper faces of the connector housings 11. Moreover, if the coupling is attempted when the female terminals 13 are in a semi-inserted position as shown in FIG. 3, the projections 16 prevent the coupling of the connector housings 11 with the receiving parts 21 in the same way. Thus, it is understood that when the coupling of the connector housings 11 with the receiving parts 21 is smoothly performed, the retainers 15 are fully engaged, and when the coupling is not smoothly performed, the retainers 15 are in the partially engaged state.

As described above, the present invention exhibits both the ability to prevent the retainers 15 on the connector housings 11 from accidently moving from the partially engaged position to the fully engaged position during transport to another location and the ability to detect whether the retainers 15 are in either the fully engaged position or the partially engaged position.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention. For example, the following preferred embodiments are included in the technical range of the present invention.

First, the number, shape and layout of the projections that are formed on the outer faces of the retainers can be arbitrarily established other than described above.

Second, the number, shape and layout of the ribs that are formed on the outer faces of the connector housings can be arbitrarily established other than described above.

Third, the present invention can be applied to a connector which includes a single connector housing in addition to the divided connectors that are equipped with several connectors on the frame. For example, the engaged position of the retainer can be detected by judging whether the retainer located on the female connector interferes with the open edge of the hood part of the male connector.

Fourth, in the preferred embodiments described above, the ribs are positioned on the outer face of the connector housing. According to the present invention, however, an embodiment wherein the ribs are not positioned on the outer face of the connector housing is possible.

Fifth, in the preferred embodiments described above, when the retainer is in the fully engaged position, the projection is designed to descend to a height flush with the upper face of the connector housing. It is not, however, always necessary for the projection to descend to this height.

The present disclosure relates to subject matter contained in Japanese Application No. 8-201919, filed on Jul. 31, 1996, which is expressly incorporated herein by reference in its entirety.

What is claimed is:

1. A connector comprising:

a connector housing that is capable of being coupled with a receiving part;

a retainer movable within said connector housing from a partially engaged position to a fully engaged position; said retainer being further adapted to prevent a terminal from being disengaged from said connector housing after said terminal is fully engaged in said connector housing; said retainer being further adapted not to extend above an outer face of said connector housing when said retainer is partially and fully engaged;

a projection located on an outer face of said retainer, at least a portion of said projection extending above the outer face of the connector housing when said retainer is partially engaged; said projection descending to a position within said connector housing when said retainer is fully engaged;

wherein said projection is capable of interfering with an open edge of said receiving part when said retainer is partially engaged and said projection no longer interferes with the open edge of the receiving part and allows the connector housing to move from a partially engaged position to a fully engaged position when said retainer is fully engaged; and at least one rib located on, and extending from, the outer face of said connector housing near said projection; said at least one rib being designed not to interfere with the open edge of the receiving part when said connector housing is being coupled with said receiving part;

said receiving part including at least one complementary recess to receive said at least one rib so that said at least one rib does not interfere with said open edge of said receiving part and allows said connector housing to be fully engaged.

2. A connector according to claim 1, comprising two of said ribs, said projection being located between said two ribs.

3. A connector according to claim 1, wherein said retainer includes an engaging part, said engaging part holding said terminal in an engaged position.

4. A connector according to claim 1, wherein said retainer is vertically movable within said connector housing.

5. A connector in accordance with claim 1, further comprising two of said ribs, wherein a top surface of said projection is positioned below the upper surface of each of said ribs.

* * * * *